US009220141B2

(12) United States Patent
Knoedgen et al.

(10) Patent No.: US 9,220,141 B2
(45) Date of Patent: Dec. 22, 2015

(54) PROGRAMMABLE SOLID STATE LIGHT BULB ASSEMBLIES

(71) Applicant: Dialog Semiconductor GmbH, Kirchheim/Teck-Nabern (DE)

(72) Inventors: Horst Knoedgen, Munich (DE); Stefan Zudrell-Koch, Hohenems (AT)

(73) Assignee: Dialog Semiconductor GmbH, Kirchheim/Teck-Nabern (DE)

( * ) Notice: Subject to any disclaimer, the term of this patent is extended or adjusted under 35 U.S.C. 154(b) by 0 days.

(21) Appl. No.: 14/250,403

(22) Filed: Apr. 11, 2014

(65) Prior Publication Data

US 2014/0217886 A1 Aug. 7, 2014

Related U.S. Application Data

(63) Continuation of application No. PCT/EP2012/070225, filed on Oct. 11, 2012.

(60) Provisional application No. 61/546,430, filed on Oct. 12, 2011.

(51) Int. Cl.
*H05B 37/02* (2006.01)
*H05B 33/08* (2006.01)

(52) U.S. Cl.
CPC ..... *H05B 33/0842* (2013.01); *H05B 33/0848* (2013.01); *H05B 33/0866* (2013.01)

(58) Field of Classification Search
CPC ..... H05B 33/0815; H05B 33/0818; H05B 37/029; H05B 41/3925; H05B 41/2828; H05B 33/0803
USPC ..... 315/291, 297, 307, 149
See application file for complete search history.

(56) References Cited

U.S. PATENT DOCUMENTS

| | | | | |
|---|---|---|---|---|
| 2007/0252738 | A1* | 11/2007 | Nakagawa | 341/143 |
| 2008/0129146 | A1* | 6/2008 | Puskas | 310/317 |
| 2010/0277072 | A1* | 11/2010 | Draper et al. | 315/149 |
| 2011/0111700 | A1* | 5/2011 | Hackett | 455/41.2 |
| 2012/0081015 | A1* | 4/2012 | Shimomura et al. | 315/188 |
| 2013/0002968 | A1* | 1/2013 | Bridge et al. | 348/744 |

* cited by examiner

*Primary Examiner* — Douglas W Owens
*Assistant Examiner* — Syed M Kaiser
(74) *Attorney, Agent, or Firm* — Saile Ackerman LLC; Stephen B. Ackerman

(57) ABSTRACT

A driver circuit for programmable solid state light bulb assemblies including light emitting diodes is operable to provide a drive current to a light source of the light bulb assembly. The controller comprises a data storage unit storing a test scenario for calibration of the light bulb assembly; wherein the test scenario indicates a sequence of states of the light source; wherein a state of the light source is associated with settings of the driver circuit; a data input unit receiving a command signal via a modulated electricity supply signal; and a data processing unit retrieving the test scenario from the data storage unit; in dependence of the received command signal, generating a control signal for operating the light source in at least one state of the sequence of states of the test scenario; and to output the control signal.

14 Claims, 8 Drawing Sheets

PROGRAMMABLE SOLID STATE LIGHT BULB ASSEMBLIES

This application is a Continuation of PCT Application no. PCT/EP2012/070225, which was filed on Oct. 11, 2012, and which is herein incorporated by reference in its entirety.

TECHNICAL FIELD

The present document relates to programmable solid state light bulb assemblies and, in particular, light bulb assemblies including light emitting diodes.

BACKGROUND

There is an increasing interest in electric light bulbs which do not make use of incandescent filaments, since filament-based light bulbs are considered to be inefficient and energy hungry. Indeed, recent legislative changes mean that traditional incandescent light bulbs are being phased out in many parts of the world. One existing replacement for the incandescent light bulb is the compact fluorescent tube bulb.

Solid state lighting, for example light emitting diode (LED) or organic light emitting diode (OLED) based retrofit lamps, offer superior performance over compact fluorescent lamp (CFL) based retrofit lamps in terms of efficiency, instant light output, light quality, and lifetime. The main barrier to penetrate the market is product cost, since the shop price of today's LED-based lamps can be up to 10 times that of CFL lamps.

A key element of an LED lamp assembly is the LED light source. The luminous efficiency, measured in lumen per watt, has been improved significantly over the last 10 years, and continues to increase further to levels of 250 lm/W for white light LEDs, with potential for further improvement.

Another strong advantage of using LED light sources is that they offer superior lifetime since the only failure mode is a slow depreciation of the outcoupling optics of the light source.

In order to exploit the enormous advantages of LED in terms of its luminous efficiency and its potentially superior lifetime, it is necessary to maintain the LED device strictly below its specified maximum temperature.

Although the LED offers excellent luminous efficiency over alternative light source technologies one strong disadvantage of any solid state light source is that there is no radiation of energy in the form of infrared radiation so that any power losses inside the light source component has to be propagated to the environment purely by heat conduction.

Another aspect of maintaining the LED at or below a desired temperature is that the efficiency of the device degrades with increasing temperature, thereby increasing further the device temperature, assuming the power provided by the power supply is kept at a constant level.

The fast and dynamic improvement of LED efficiency can be utilized only if the manufacturer of solid state light source (SSL) based lamp assemblies can change their product to accommodate new generations of SSL components. This requires normally a redesign of components within the power supply or driver unit inside the SSL lamp assembly due to changing requirements of the SSL. Such redesign tasks are resource and time intensive and increase heavily the total cost for the manufacturer of SSL lamp assemblies.

One major cost factor in manufacturing SSL lamp assemblies are the SSL devices. The manufacturing of SSL devices involves process steps with major statistical variance. Small variations in manufacturing process steps yield shifts in the dominant wavelength that an SSL chip radiates and this impacts directly the luminous characteristic of white light LEDs and OLEDs. Also the manufacturing process impacts the forward voltage of SSL devices which contributes substantially to the power that is delivered to the device when operated with a power supply unit with current source characteristic.

Due to these said large variance of SSL productions such devices are selected according to their respective characteristic into so called bins. Binning adds major complexity to all stages of the supply chain and results in substantial cost premiums.

Another aspect is that the interaction of the SSL device and the power supply unit within the SSL lamp assembly again extends the tolerance window of the actual optical and electrical operating point at which the SSL device is operating in a given application and location.

Accordingly, it is desirable to produce a driver circuit for a solid state light bulb assembly which enables the drawbacks of the existing designs to be overcome.

SUMMARY

According to an aspect a controller for a driver circuit is described. The driver circuit may be operable to provide a drive signal (in particular a drive current) to a light source (e.g. an SSL source) of a light bulb assembly. The controller may comprise a data storage unit (e.g. a digital data storage unit) operable to store a test scenario for calibration of the light bulb assembly. It may be an object of the calibration to determine a set of settings (referred to e.g. as the final set of settings) for the driver circuit, which operates the light source such that the light source emits light which meets pre-determined target illumination characteristics. The set of settings may comprise one or more of: a duty cycle of a power converter of the driver circuit, a commutation cycle rate of the power converter, and/or a drive current. In case of a light source which comprises multiple SSL sources (e.g. multiple LEDs), the set of settings may comprise multiple drive currents for the corresponding multiple SSL sources. By using multiple SSL sources which cover different frequency ranges, respectively, the spectrum/color of the light source may be modified. The illumination characteristics may comprise e.g. a spectrum of light emitted by the light source; a color of the light emitted by the light source; an intensity of the light emitted by the light source; and/or a color rendering index of the light source.

The test scenario may be indicative of a sequence of states (e.g. a sequence of illumination states) of the light source. A state of the light source may be associated with a corresponding set of settings of the driver circuit. In other words, a set of settings of the driver circuit may result in a corresponding illumination state of the light source. The data storage unit may be configured to store a plurality of sets of settings of the driver circuit, which is associated with the sequence of states, respectively. In other words, the plurality of sets of settings which result in the sequence of illumination states may be stored in the data storage unit. The test scenario may be further indicative of a temporal progression of the sequence of states. In other words, the test scenario may define time intervals for the progression between succeeding states from the sequence of states. As such, the test scenario may also specify the time interval for executing the test scenario, i.e. the time interval for executing the sequence of states.

The controller may comprise a data input unit operable to receive a command signal via a modulated electricity supply signal. The electricity supply signal may be derived from the mains supply. The command signal may correspond to a pre-determined modulation pattern of the electricity supply signal. Possible modulation schemes are described in the present document (e.g. amplitude modulation and/or frequency modulation). The command signal may comprise one or more of a start signal triggering an execution of the test scenario; a next signal triggering the operation of the light source in a state of the sequence of states, which follows a current state of the light source; and/or a stop signal triggering an interruption of the execution of the test scenario.

The controller may further comprise a data processing unit operable to retrieve the test scenario from the data storage unit. In particular, the data processing unit may be configured to retrieve the sets of settings associated with the sequence of states of the test scenario. Furthermore, the data processing unit may be configured to generate a control signal for operating the light source in at least one state of the sequence of states of the test scenario. The at least one state may be selected in dependence of the received command signal. By way of example, a start signal may trigger the execution of the test scenario, starting with the first state of the sequence of states. A next signal may trigger the implementation of a following state from the sequence of states. A stop signal may lead to a termination of the test scenario. In addition, the data processing unit may be configured to output the control signal to the driver circuit (in particular to the power converter of the driver circuit), in order to put the light source into the corresponding illumination state.

The data processing unit may be configured to select one state of the sequence of states based on the received command signal. By way of example, the controller may receive a stop signal and the data processing unit may select the state which is implemented at the time instant of the reception of the stop signal. Furthermore, the data processing unit may be configured to determine the final set of settings, which is used by the light bulb assembly subsequent to calibration, based on the set of settings which is associated with the selected state. By way of example, the final set of settings may correspond to the set of settings which is associated with the selected state. As indicated above, the selected state may correspond to the state of the sequence of states that the light source is operated in upon reception of a stop (command) signal instructing the controller to stop execution of the test scenario.

Overall, the controller may be configured to calibrate the light bulb assembly, i.e. to determine a final set of settings for the light bulb assembly, without the need of transmitting settings of the light bulb assembly via the electrical supply signal. By doing this, the calibration process can be accelerated and rendered more robust.

The data storage unit may be configured to store a plurality of test scenarios comprising a first and a second test scenario. The data input unit may be operable to receive a plurality of command signals via the modulated electricity supply signal. The data processing unit may be configured to determine a first set of settings from the first test scenario and a second set of settings from the second test scenario, based on the plurality of command signals. By way of example, a first stop command signal may determine the first set of settings (during execution of the first test scenario) and a subsequent second stop command signal may determine the second set of settings (during execution of the second test scenario). The data processing unit may be configured to determine the final set of settings, which is used by the light bulb assembly subsequent to calibration, based on the first and second sets of settings. By using a plurality of test scenarios, the precision of the calibration process (and of the final set of settings) may be improved.

The first test scenario may be indicative of a sequence of states of the light source, which alters a first illumination characteristic of light emitted by the light source. The second test scenario may be indicative of a sequence of states of the light source, which alters a second illumination characteristic of the light emitted by the light source. The first and second illumination characteristics may be different from one another. By way of example, the first test scenario may be used to tune the first illumination characteristic (e.g. the spectrum) and the second test scenario may be used to tune a second illumination characteristic (e.g. the intensity). The final set of settings may be determined based on the first and second sets of settings, e.g. based on an average of the first and second sets of settings.

The first test scenario may be indicative of a sequence of states of the light source, which alters a first illumination characteristic of light emitted by the light source in a first manner (e.g. progressively increasing the intensity of the light and/or progressively increasing a frequency of the emitted light). The second test scenario may be indicative of a sequence of states of the light source, which alters the first illumination characteristic of light emitted by the light source in a second manner (e.g. progressively decreasing the intensity of the light and/or progressively decreasing a frequency of the emitted light). The first and second manners may be different from one another. The final set of settings may be determined based on the first and second sets of settings, e.g. based on an average of the first and second sets of settings.

The data processing unit may be operable to generate a control signal for operating the light source in a reach-through state. In the reach-through state an illumination characteristic of light emitted by the light source may be sensitive to the electricity supply signal. By way of example, the illumination characteristic may be sensitive to a level, a frequency and/or a modulation of the electricity supply signal.

According to a further aspect, a controller for a driver circuit is described. The driver circuit may be operable to provide a drive current to a light source of a light bulb assembly. The controller may correspond to the above mentioned controller. In particular, the controller may comprise a data processing unit. The data processing unit may be operable to determine information which is to be transmitted by the light bulb assembly.

The information may be determined from a set of settings of the driver circuit which is stored in a data storage unit of the controller. Furthermore, the data processing unit may be configured to determine a modulation pattern indicative of the information. A control signal may be generated. The control signal may be for operating the driver circuit such that the light bulb assembly draws power from a mains supply in accordance to the modulation pattern. The control signal may be output to the driver circuit, such that the light bulb assembly draws power from a mains supply in accordance to the modulation pattern.

The power which is drawn from the mains supply may be modulated by modulating a current drawn from the mains supply. By way of example, a first stage of the power converter of the driver circuit may comprise a switch device which is operated at a pre-determined commutation cycle rate in accordance to a pre-determined duty cycle. The duty cycle may be interrupted in accordance to the modulation pattern, thereby modulating the current drawn from the mains supply in accordance to the modulation pattern, and thereby modulating the power drawn from the mains supply in accordance to the modulation pattern. The commutation cycle rate may be in the range of 10 kHz, thereby allowing for a relatively high modulation speed and a relatively high data rate for transmissions from the light bulb assembly to an external receiver. The controller may be configured to decouple and/or to bypass an input capacitance and/or electromagnetic interference (EMI) circuitry, when communicating information via the modulated power/current from the light bulb assembly to the external receiver.

According to another aspect, a driver circuit for a solid state light bulb assembly is described. The driver circuit may comprise a power converter operable to output a drive signal (e.g. a drive voltage and/or a drive current) to a solid state light source in dependence upon a received control signal. Furthermore, the driver circuit may comprise a controller according to any of the aspects described in the present document. The controller may be operable to provide the control signal for the power converter.

According to a further aspect, a light bulb assembly is described. The light bulb assembly may comprise a housing, a solid state light emitting device located within the housing and an electrical connection module attached to the housing and adapted for connection to a mains supply. Furthermore, the light bulb assembly may comprise a driver circuit according to any of the aspects described in the present document. The driver circuit may be located within the housing, and may be connected to receive an electricity supply signal from the electrical connection module. Furthermore, the driver circuit may be operable to supply an electrical drive signal to the light emitting device.

According to a further aspect, a calibration system is described. The calibration system may be configured to calibrate a light bulb assembly comprising a controller according to any of the aspects described in the present document. The calibration system may comprise a programming unit configured to control the execution of a test scenario stored in the controller of the light bulb assembly. For this purpose, the programming unit may be configured to modulate a command signal (e.g. a start signal or a stop signal) onto an electricity supply signal for the light bulb assembly. Furthermore, the calibration system may comprise a sensor unit configured to capture light emitted by the light bulb assembly. The programming unit may be configured to determine the command signal based on the captured light. In particular, the programming unit may be configured to determine whether an illumination characteristic of the light emitted by the light bulb assembly corresponds a target illumination characteristic. If this is the case, the programming unit may send a stop signal to the controller of the light bulb assembly, thereby indicating to the controller that the current illumination state corresponds to the target illumination state.

According to a further aspect, a communication system is described. The communication system comprises a light bulb assembly according to any of the aspects described in the present document. In particular, the light bulb assembly comprises an electrical connection module adapted for connection to a mains supply, and a controller according to any of the aspects described in the present document. The controller may be configured to operate the light bulb assembly such that the light bulb assembly draws power from the mains supply in accordance to a modulation pattern indicative of information. Furthermore, the communication system may comprise a reception unit external to the light bulb assembly, coupled to the electrical connection module of the light bulb assembly and configured to detect the modulation pattern from the power drawn by the light bulb assembly.

According to one aspect, there is provided a controller for a driver circuit which is operable to provide drive current to a solid state light emitting device of a light bulb assembly, the controller comprising a digital data storage unit operable to store control data items, a digital data processing unit operable to retrieve control data items from the data storage unit, to generate a control signal in dependence upon retrieved control data items, and to output such a control signal, and a data input unit operable to receive data items for storage in the data storage unit via a modulated electricity supply signal.

According to another aspect, there is provided a driver circuit for providing a drive current to a solid state light emitting device of a light bulb assembly, the driver circuit comprising a power converter circuit operable to receive an electricity supply signal, and to supply an electrical drive signal to a light emitting device of a light bulb assembly, and a controller comprising a digital data storage unit operable to store control data items, a digital data processing unit operable to retrieve control data items from the data storage unit, to generate a control signal in dependence upon retrieved control data items, and to output such a control signal to the power converter, and a data input unit operable to receive data items for storage in the data storage unit via a modulated electricity supply signal.

According to another aspect, there is provided a light bulb assembly comprising a housing, a solid state light emitting device, located within the housing, an electrical connection module, attached to the housing, and adapted for connection to an electrical supply, a driver circuit located within the housing, connected to receive an electricity supply signal from the electrical connection module, operable to supply an electrical drive signal to the light emitting device, and comprising a power converter circuit including at least one switching device, and at least one inductive energy storage device, the power converter circuit being operable to receive an electricity supply signal from the electrical connection module, and to output an electrical drive signal to the light emitting device, and a controller comprising a digital data storage unit operable to store control data items, a digital data processing unit operable to retrieve control data items from the data storage unit, to generate a control signal in dependence upon retrieved control data items, and to output such a control signal to the power converter, and a data input unit operable to receive data items for storage in the data storage unit via a modulated electricity supply signal.

In one example, the control data items relate to a predetermined operating characteristic of such a light emitting device. In one example, the control data items relate to an intensity of an output light signal of such a light emitting device. In one example, the control data items relate to a spectrum of output light signal of such a light emitting device.

In one example, the data input unit is operable to detect directly a modulated electricity supply signal and to convert a detected modulated electricity supply signal to control data items for storage in the data storage unit. In one example, the data input unit is operable to detect a voltage change within such a driver circuit, such a voltage change being caused by an input modulated electricity supply signal, and to convert a detected voltage change to control data items for storage in the data storage device.

In one example, such a power converter circuit comprises a first power converter stage connected to receive an electricity supply signal from the electrical connection module, and operable to draw electrical energy from the electrical connection module in dependence upon a first control signal received from the controller, a capacitive electrical energy storage device connected for reception of electrical energy from the first power converter stage, and a second power converter stage, connected to receive electrical energy from the first power converter stage and from the electrical energy storage device, and operable to output an electrical drive current to the solid state light emitting device in dependence upon a second control signal received from the controller, wherein the controller is operable to generate such first and second control signals.

In one example, the input modulated electricity supply signal is not equal in voltage to a rated input operation electricity supply signal. In one particular example, the input modulated signal has an average voltage level substantially lower than an operating supply signal for the light bulb assembly. The input modulated signal may be modulated using any appropriate modulation scheme including one of a baseband modulation scheme, an amplitude modulation scheme, and a frequency modulation scheme. The modulation scheme used may cause the average voltage of the input modulate signal to be above a predetermined level at substantially all times. In one example, the input modulated electricity supply signal is modulated using a Manchester Code scheme.

According to another aspect, there is provided a method of programming a controller of a driver circuit which is operable to supply a drive current to a solid state light emitting device of a light bulb assembly, the method comprising generating a modulated electricity supply signal which encodes control data items for storage by the controller, and supplying such a modulated electricity supply signal to the controller via an electricity supply connection of the light bulb assembly. One example method further comprises causing a drive current to be supplied to a light emitting device of a light bulb assembly, generating a measurement signal indicative of a parameter of a light signal output by the light emitting device, and determining such control data items in dependence upon the measurement signal.

According to another aspect, there is provided a system for programming a controller of a driver circuit which is operable to supply a drive current to a solid state light emitting device of a light bulb assembly, the system comprising a programming unit operable to generate a modulated electricity supply signal which encodes control data items for storage by the controller, and to supply such a modulated electricity supply signal to the controller via an electricity supply connection of the light bulb assembly. One example of such a system further comprises a sensor unit operable to generate a measurement signal indicative of a parameter of a light signal output by the light emitting device, and to supply such a measurement signal to the programming unit, wherein the programming unit is operable to determine such control data items in dependence upon a measurement signal received from the sensor unit.

In one example, the system comprises a power converter with at least one inductive storage element and at least one switching device which receives a control input signal holding information about the amount of power delivered to the SSL devices. Such a system comprises a digital controller which generates a control signal holding information about the amount of power delivered to the SSL devices. In one example the control signal comprises a vector of PWM control signals controlling each power switch inside the converter.

Such a system includes a non-volatile memory device, and an interface module which demodulates information received from the power converter into data to be stored in the memory device. In one example, the interface is connected to the rectified mains voltage. In one example, the interface decodes information out of the sensing signals received from the power converter which are representative of the input voltage.

A light sensor may be mounted external to the SSL lamp assembly, and operates to measure the luminous intensity, or any other luminous parameter representative of the lumen output of the SSL lamp assembly. In one example the sensor measures the color correlated temperature of the generated lumen output. In one example, the sensor measures the light spectrum of the generated lumen output. In one further example, the sensor measures the color rendering index of the generated lumen output.

A programming system comprises a programmable voltage source which is programmed to generate different supply voltage patterns to operate the SSL lamp assembly either under nominal input voltage condition or to generate a modulated voltage input to the SSL lamp assembly in order to calibrate the lamp.

In one example the proposed technique overcomes disadvantages of large process variance by the following method: Operate the SSL devices under nominal uncalibrated conditions; Measure the lumen output under nominal conditions; Evaluate the measured lumen output according to one of the said luminous characteristics or parameters; Calculate correction information; Program the voltage source to generate a modulated input voltage into the SSL lamp assembly representing the correction information; and The SSL lamp assembly receiving the correction information and storing the information inside the memory device.

In one example, the proposed technique overcomes the disadvantage of large process variance by the following method: Operate the SSL devices under nominal uncalibrated conditions; Measure the lumen output under nominal conditions; Evaluate the measured lumen output according to one of the said luminous characteristics or parameters; Calculate correction information; Program the voltage source to generate a modulated input voltage into the SSL lamp assembly representing the correction information; The SSL lamp adapting the light output according to the correction information; Repeating the steps until the generated light output meets a target value; Programming the voltage into the SSL lamp assembly to acknowledge the most recent setting; and The SSL lamp assembly storing the most recent setting into the memory device.

In one example the voltage source is programmed to represent information to be stored in the memory device, the information being behavioral characteristics of the power converter.

In one example the voltage source is programmed to represent information to be stored in the memory device, the information enabling or disabling features of the driver circuit inside the SSL lamp assembly. Features are in one example dimmability or the response to switching events on the input mains voltage.

The control circuit may be implemented using hardwired logic, programmable gate arrays a microcontroller and/or a programmable digital control IC sensitive to events.

DETAILED DESCRIPTION

In the current context, a light bulb "assembly" includes all of the components required to replace a traditional incandescent filament-based light bulb. As will become clear from the description of the examples given below, the methods and systems described in the present document are applicable to light bulb assemblies for connection to the standard electricity supply. In British English, this electricity supply is known as "mains" electricity. Whilst in US English, this supply is known as power line. Other terms include AC power, line power, domestic power and grid power. It is to be understood that these terms are readily interchangeable, and carry the same meaning.

Typically, in Europe electricity is supplied at 230-240 VAC, at 50 Hz and in North America at 110-120 VAC at 60 Hz. The principles set out below apply to any suitable electricity supply, including the main/power line mentioned, and a DC power supply, and a rectified AC power supply.

Figure 1:
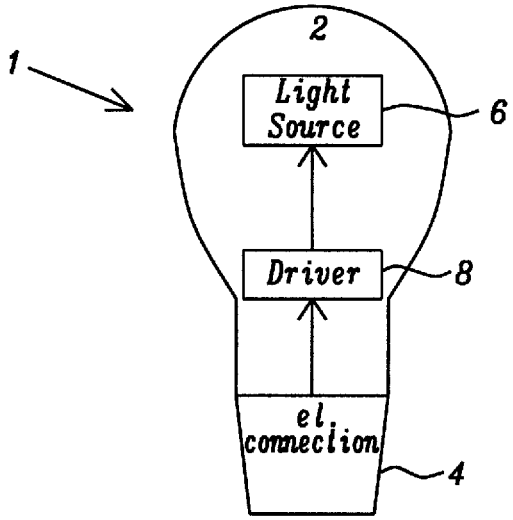
FIG. 1 is a schematic view of a light bulb assembly.

FIG. 1 is a schematic view of a light bulb assembly. The assembly 1 comprises a bulb housing 2 and an electrical connection module 4. The electrical connection module 4 can be of a screw type or of a bayonet type, or of any other suitable connection to a light bulb socket. A solid state light source 6, for example a light emitting diode (LED) or organic light emitting diode (OLED), is provided within the housing 2. The light source 6 may be provided by a single light emitting device, or by a plurality of such devices.

Drive circuitry 8 is located within the bulb housing 2, and serves to convert supply electricity received through the electrical connection module 4 into a controlled drive current for the solid state light source 6.

The housing 2 provides a suitably robust enclosure for the light source and drive components, and also provides a heat-sink capability. Management of the temperature of the light source is important in increasing (e.g. maximizing) light output and light source life. Accordingly, the housing is designed to enable heat generated by the light source to be conducted away from the light source, and out of the assembly as a whole. One complication of the housing design is that, for consumer products, the outer temperature of the housing must be suitably low to prevent injury to a user. These requirements can lead to housing designs that are complex to manufacture. Accordingly, careful and accurate management of the thermal characteristics of the light bulb is desirable.

Figure 2:
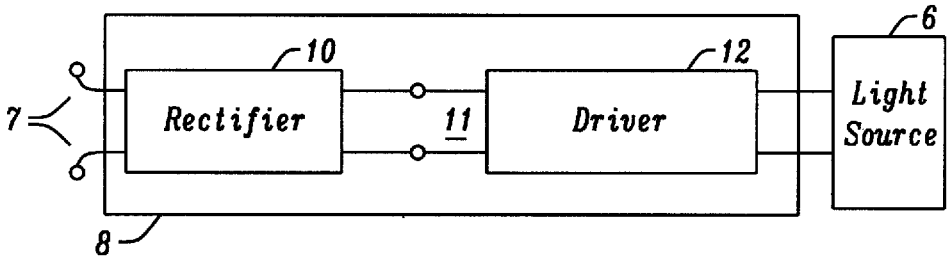
FIG. 2 is a schematic block diagram of circuitry of the assembly of FIG. 1.

FIG. 2 illustrates the drive circuitry 8 and light source 6 of FIG. 1 in more detail. The drive circuitry 8 comprises a rectifier 10 which receives alternating current (AC) supply electricity, and delivers a rectified current (DC) 11 at its output. This DC power is received by a driver 12 which serves to output a controlled DC drive signal to provide electrical power to the light source 6. The voltage and current characteristics of the output drive signal from the driver 12 are determined by the type and number of light emitting devices employed in the light source 6. The power supplied to the light source 6 is controlled in dependence upon desired operating conditions of the light source 6. In one example, the light source includes a plurality of light emitting devices, and requires a drive signal having a voltage of 50V or more. In general, the drive signal (i.e. the drive voltage providing the on-voltage of the light source 6) may be in the range of 10V to over 100V.

Figure 3:
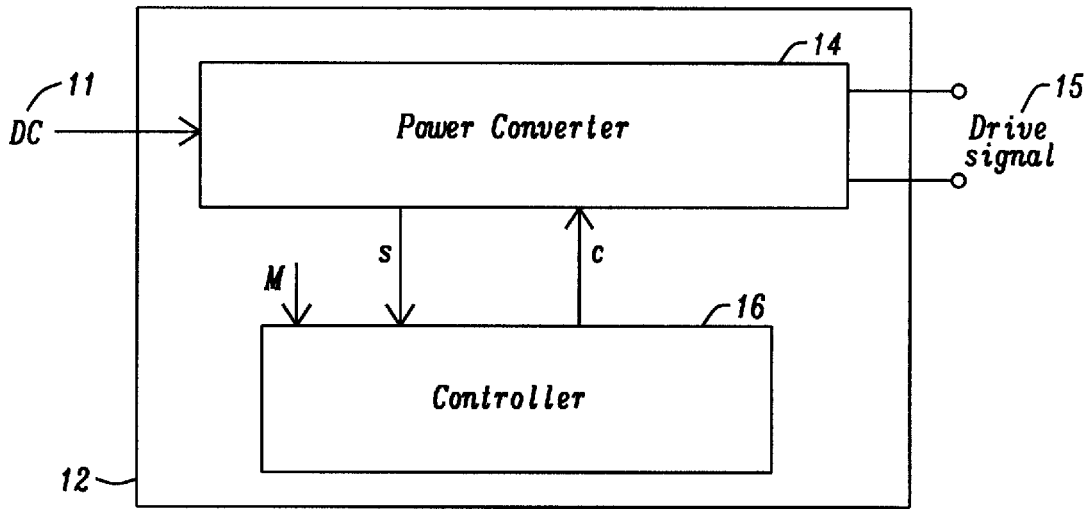
FIG. 3 is a schematic block diagram of an example driver circuit for use in the circuitry of FIG. 2.

FIG. 3 illustrates an example driver 12 suitable for use in the drive circuitry 8 of FIG. 2. The driver 12 includes a power converter 14, and a controller 16. The power converter 14 receives DC power 11 from the rectifier 10, and operates to output a controlled drive signal 15 to the light source 6. It will be appreciated that the rectifier 10 may be replaced by a remotely located rectifier that supplies rectified AC power to the light bulb assembly, or by a DC power source such as a battery.

In the case where the light source 6 includes a plurality of light emitting devices, those devices may be controlled by a single drive signal, or may be controlled by individual drive signals representing different control channels. Alternatively, the devices may be controlled in predetermined groups, each having a control signal or channel. One example of multiple channel control is when the light source produces white light using red, green and blue devices (RGB devices). Separate control channels enable the color spectrum of the white output light to be tuned. Such control is also applicable to the case when devices having different white color temperatures are used.

The controller receives sensor or feedback signals S relating to the operation of the power converter 14 and/or to the operation of the light source 6, and provides control signals C to the power converter 14 in order that the drive signal 15 is appropriate to the desired operation of the light source 6. Operation of the controller will be explained in more detail below.

The controller 16 may be operable to receive a modulated signal M. This signal M may be the rectified supply signal 11, or may be a signal derived therefrom. As will be described in detail below, the modulated signal is used to transfer data to the controller 16 via the electrical supply connection.

The power converter 14 comprises at least one inductive energy storage device, and at least one switch device. The switch device is controlled by the controller 16, and may be provided by a metal oxide semiconductor field effect transistor (MOSFET) device, or other device suitable for switching high voltage (for example, tens of volts). The power converter can be provided by any suitable circuit topology. For example, a buck converter circuit, a boost converter circuit, a buck/boost converter circuit, a SEPIC (single-ended primary-inductor converter) circuit, or a flyback converter circuit could be used for the power converter 14.

It will be appreciated that the power converter 14 may be provided by any suitable power converter topology. The converter may include multiple stages, provided by any suitable combination of power converter topologies. Multiple stages may be used e.g. to provide for relatively high voltage conversion ratios (between the input voltage 11 and the output voltage 15).

Figure 4:
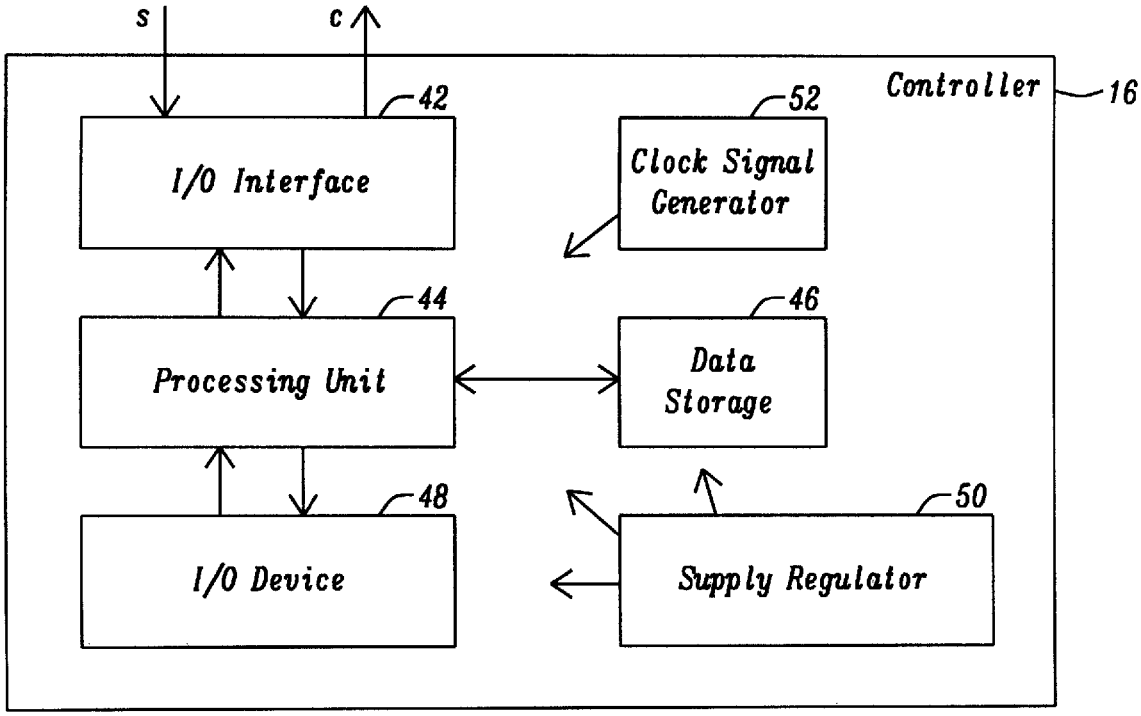
FIG. 4 is a schematic block diagram of an example controller for use in the driver of FIG. 3.

FIG. 4 illustrates an example of a controller 16 suitable for use in the driver of FIG. 3. The controller 16 includes input/output interface unit 42 for receiving sensor/feedback signals S, and modulated signals M, and for outputting control signals C, a processing unit 44 for overall control of the system, and a data storage device (or data storage unit 46 for storing data for use by the processing device. A communications input/output device 48 may be provided for enabling the processing unit 44 to communicate with other devices, for example using a suitable wired or wireless communications protocol. The controller 16 also incorporates a power supply regulator 50, which supplies power to the devices within the controller 16, and a clock signal generator 52 (such as an oscillator circuit) for supplying a reference clock signal to the processing unit 44.

The processing unit 44 operates to generate the control signals C for controlling the switch device or devices in the power converter. Typically, the control signals will be pulse width modulated signals that control the duty cycle (that is, the ratio of 'on' to 'off') of the switch device in the power converter, and hence to control the output drive signal 15. The processing unit combines received signals relating to the operating conditions of the power converter and/or the light source, with behavior information stored as data in the data storage device 46. The processing unit 44 uses the input signals in combination with the stored behavior information to determine the correct control signal values for output to the power converter.

In a programming mode of operation, the supply voltage signal is modulated in order to provide encoded data to the controller 16. The modulated signal, or a derivative thereof, is supplied to the input/output interface unit 42. The unit 42 operates to demodulate the signal and to convert the demodulated signal into a data stream for supply to the processing unit 44. The processing unit 44 stores the data items in the data stream in the data storage device 46.

In such a manner, it is possible to provide control data, or programming information, to the controller during, or following, manufacture of the light bulb assembly. Since such data is supplied through the electricity supply module, no additional connections of interfaces are required.

The supplied data can be used to provide a common controller with a predefined set of functions. For example, one application may require sophisticated dimming capabilities, whereas another may require only simple on-off functionality.

However, a single, standard controller can be used, by virtue of its programmability. Use of such a standard controller enables costs to be reduced across the range of applications.

The use of the modulated supply signal for programming the controller may be temporally distinct from the operation of the lamp assembly. That is, the programming of the controller takes place separately from the operation of the lamp, for example during manufacture of the lamp. The use of a non-volatile memory unit enables programming to be carried out during manufacture, and then the programmed controller to be ready to use when following purchase by a consumer.

In one example, the programming is not intended to be made "on-the-fly" during lamp operation. The programmability of the controller is primarily intended to enable a common controller circuit to be used in multiple applications.

Figure 5:
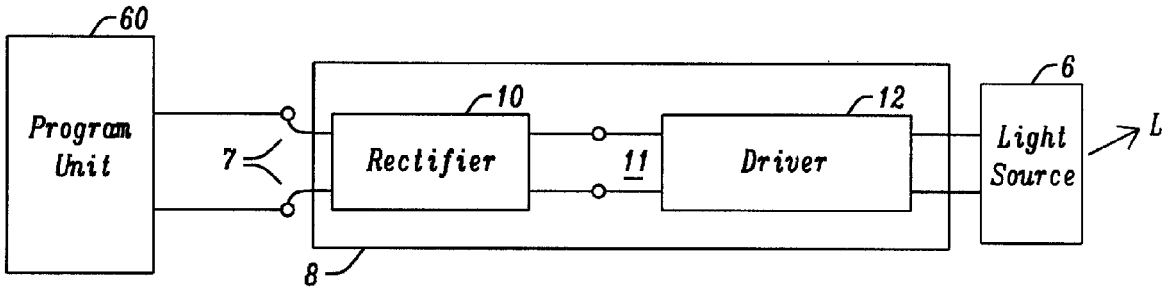
FIG. 5 is a schematic block diagram illustrating one example of programming the driver circuit of FIG. 3.

FIG. 5 illustrates a first programming technique in which a programming unit 60 is connected to an electricity supply input 7 of the light bulb assembly. The input 7 is provided by the electrical connection module 4 of the assembly 1. The programming unit 60 supplies a modulated electricity supply signal to the light bulb assembly, in order to provide data to the controller 16 of the driver 12.

Figure 6:
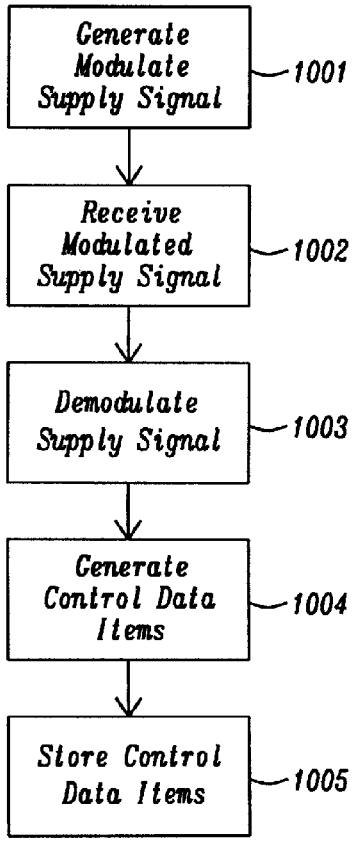
FIG. 6 is a flowchart illustrating steps in an example method of programming the driver circuit of FIG. 3.

FIG. 6 illustrates steps in an example method using the programming unit 60 shown in FIG. 5. Data to be supplied to the controller is generated or retrieved by the programming unit 60 (step 1001), and then a modulated electricity supply signal is provided to the electrical connection module of the assembly (step 1002) by the programming unit 60. The modulated signal or a derivative thereof, is demodulated (step 1003). From the demodulated signal, the control data items are generated (step 1004), and then these data items are stored in the data storage device (step 1004). The light source 6 can then be controlled in dependence upon the control data items stored in the controller of the driver circuitry.

Using such a method, it is possible to program the controller for a particular application during manufacture of the light bulb assembly. This means that a single controller is able to be used in a plurality of applications, with the particular functionality required by an application being applied to the controller during manufacture.

Figure 7:
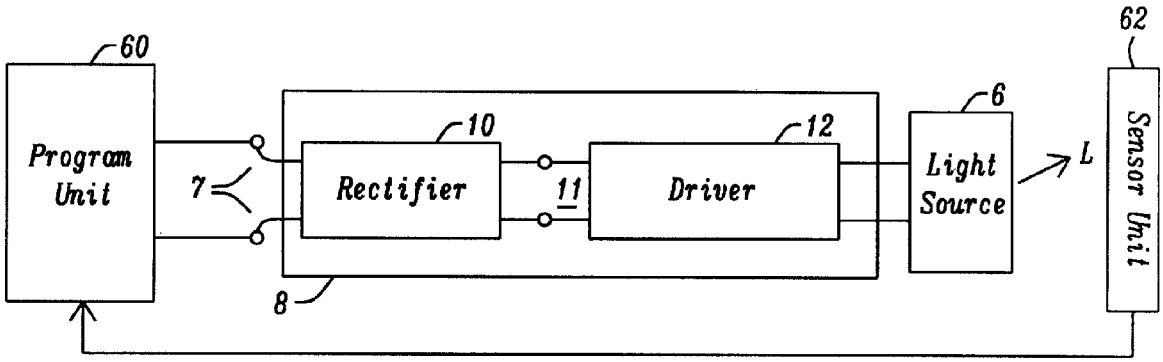
FIG. 7 is a schematic block diagram illustrating another example of programming the driver circuit of FIG. 3.

FIG. 7 illustrates a second programming technique in which a programming unit 60 is connected to an electricity supply input 7 of the light bulb assembly. The input 7 is provided by the electrical connection module 4 of the assembly 1. The programming unit 60 supplies a modulated electricity supply signal to the light bulb assembly, in order to provide data to the controller 16 of the driver 12. A sensor unit 62 is provided for detecting light output from the light source 6. The sensor unit 62 generates a measurement signal indicative of a desired parameter or parameters of the light signal output from the light source 6. The measurement signal is supplied to the programming unit 60 which generates the modulated supply signal on the basis of the measurement signal and stored information. The modulated supply signal then causes control data items to be stored in the data storage unit of the controller. The control data items are then used to control the light output from the light source 6.

Figure 8:
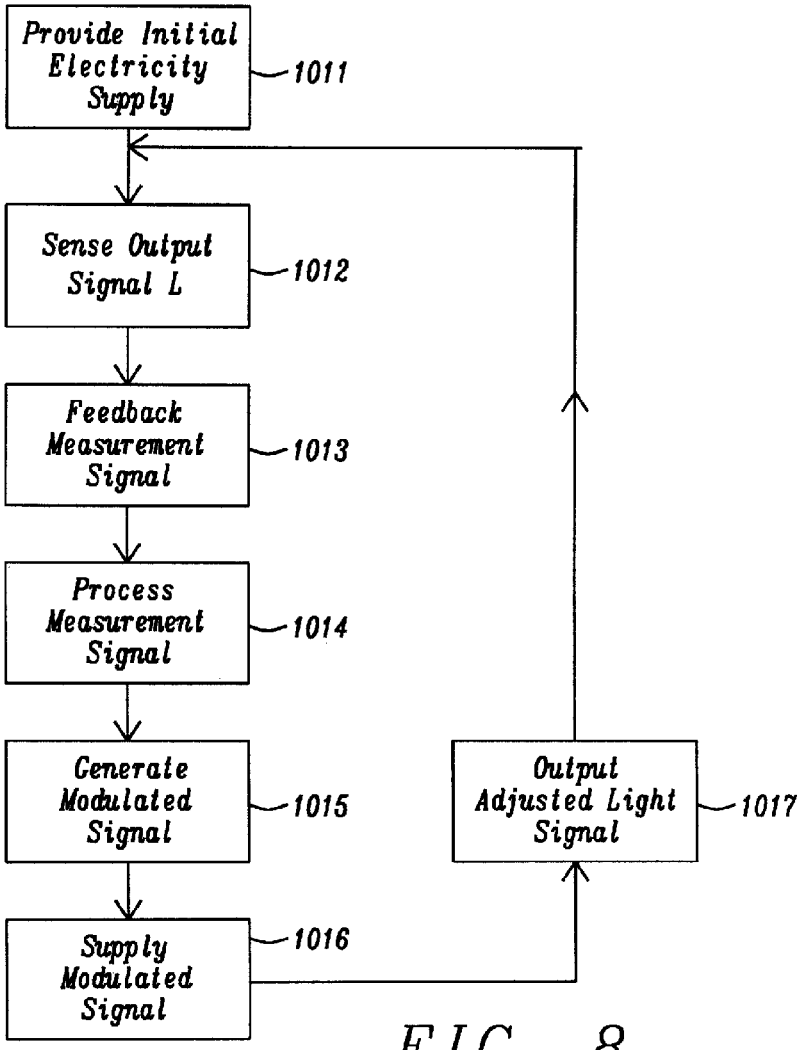
FIG. 8 is a flowchart illustrating steps in another example method of programming the driver circuit of FIG. 3.

FIG. 8 shows steps in another method. Electricity is supplied to the light bulb (step 1010), to cause the light source to output a light signal L in accordance with an initial default setting. The output light signal L is sensed (step 1011) by the sensor unit 62, and a measurement signal returned to the programming unit 60 (step 1012). The programming unit 60 processes the measurement signal (step 1013) in accordance with a predetermined algorithm or method to produce the data required to be transmitted to the controller. A modulated supply signal is generated on the basis of the control data items (step 1014), and is then supplied to the light bulb assembly (step 1015).

The controller then operates to control the light source in dependence upon the updated control data items (step 1016), thereby causing the light source to generate an adjusted output light signal. This adjusted light signal is then sensed by the sensor unit 62 for continuing the programming process until the measurement signal is within a predetermined range of values.

In such a manner, the output light generated by the light source can be calibrated to meet a required specification. For example, the output light can be adjusted such that its intensity, and/or spectrum meet desired levels. Such output specifications may be determined by the manufacturer of the light source, or may be determined by the application to which the light bulb is to be put. For example, one application may require a high intensity light having a mainly blue spectrum, whilst another application may require low intensity, mainly red light to be generated by the light source. Both applications can be catered for by the use of a programmable controller.

The light signal output by the light source may itself be a data-carrying signal, which uses a modulated light output signal. The modulated signal may be generated using any suitable modulation scheme, including, but not limited to, an amplitude or frequency modulation scheme. The modulated light signal may be used to output system status information relating to the LED and other components of the assembly for use by the programming system.

Figure 9:
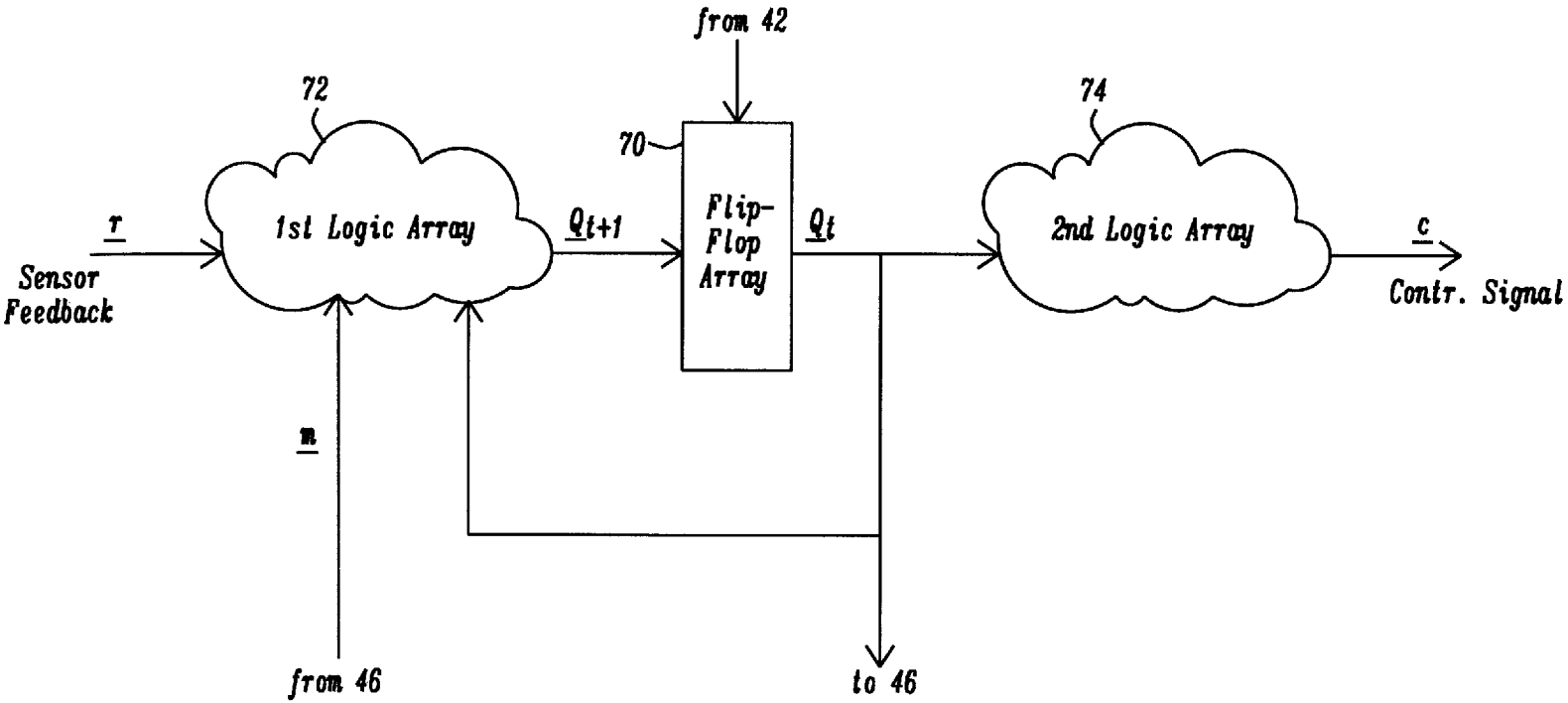
FIG. 9 is a schematic block diagram of an example processing unit for use in the controller of FIG. 7.

The processing device can be provided by any suitable topology, but advantageously is provided, at least in part, by a logic array which has its function defined by data stored in the data storage unit 46. One possible example of a processing unit is shown in FIG. 9. The example processing unit includes a flip-flop array 70 which operate to latch an output vector $O_t$ from an input vector $O_{t+1}$ with every clock signal received from the clock signal generator 52. The input vector $O_{t+1}$ is output from a first logic array 72. The first logic array 72 receives as inputs a sensor/feedback vector r, the previous output vector $O_t$, and an output vector m from the data storage device 46. The output vector $O_t$ can be used to address the data storage device 46, in order to provide the required behavioral data from the device 46. The output vector $O_t$ is provided as an input of a second logic array 74, which in turn generates an output control signal vector c for supply to the input/output interfaces 42. The input/output interface unit 42 converts the control signal vector c into a pulse width modulated signal or signals suitable for controlling the switch device or devices in the power converter.

Figure 10:
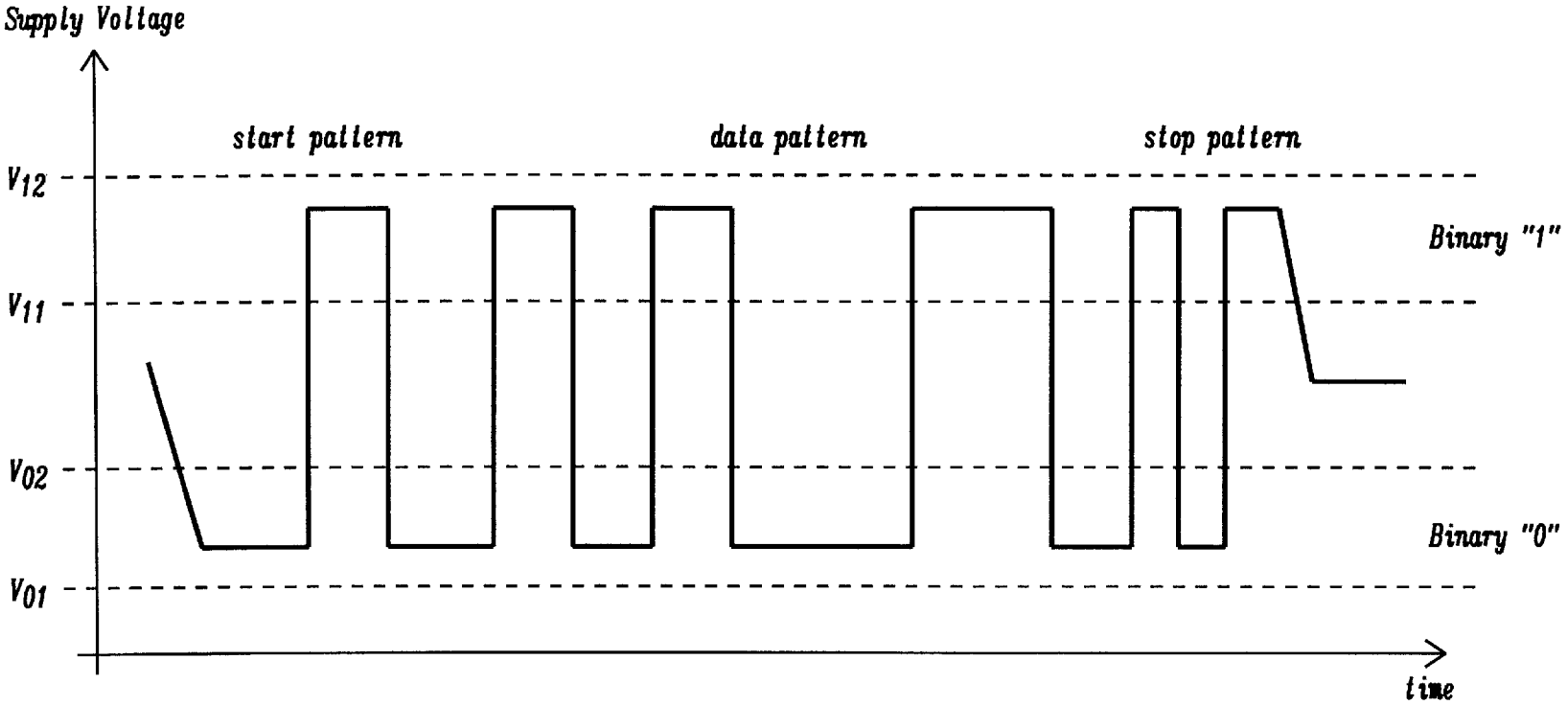
FIG. 10 illustrates a modulation scheme.

FIG. 10 illustrates an example modulation scheme suitable for use in providing data to a light bulb assembly. FIG. 10 illustrates the variation of input supply voltage over time. The supply voltage varies between a logical "0" band defined between a lower level V01 and an upper level V02, and a logical "1" band defined between a lower level V11 and an upper level V12. In the example shown, the modulated supply signal defines a start pattern for indication of the beginning of a data transfer period, the data pattern itself, and a stop pattern. The encoding of the data to be transferred can be achieved using any appropriate scheme. In one example, the so-called "Manchester Code" is used to encode the data for delivery to the controller.

The voltage levels used for the programming operation can be at any appropriate level, and not necessarily at the mains or powerline supply level. For example, the programming voltage may be significantly lower than the supply voltage for normal operation. In one example, the lower and upper levels for the logical "0" band may be 100V and 120V respectively, and the lower and upper levels for the logical "1" band may be 130V and 150V respectively, irrespective of the normal supply voltage level.

The modulation scheme may be any suitable scheme including, but not limited to, a baseband modulation scheme, an amplitude modulation scheme, or a frequency modulation scheme. In one example, the modulation is such that the average input voltage is above a predetermined level at all times regardless of the data content.

The data storage unit may be provided by a fuse array, a one-time programmable device, a flash memory device, or any other non-volatile memory device.

By making use of a programmable processing or logic block, a driver is able to be used with a variety of different combinations of power converter stages, such as buck-buck/boost, SEPIC-SEPIC, SEPIC-flyback, flyback-buck/boost, or flyback-SEPIC, simply by making use of different stored data in the data storage device. The stored data determines the behavior of the power converter stages, and so can be tailored for the specific stages that are used in any given light bulb assembly.

The control unit provided in such a driver is able to be a standard component, which results in lower manufacturing cost of the control unit, and hence of the driver. In addition, the physical size of the control unit, and driver can be optimized, so that the driver can be used in a wide range of light bulb applications of varying sizes.

The programmable control unit is able to provide the driver with a desirable range of features, such as dimming, without the need to provide a different driver circuit for each type of light bulb.

In one example, the controller is implemented on a single integrated circuit, for example using a CMOS (complementary metal oxide semiconductor) sub 0.35 um process.

The processing unit 44 may operate to monitor for a demodulated data stream continually while the light bulb assembly is powered up, or may enter the programming mode only once following initial power up.

It will be appreciated that the term "solid state light source" includes light emitting diodes (LEDs), organic light emitting diodes (OLEDs), and any other appropriate solid state device. Such light sources may generate any desired spectrum of output light.

In the present document, methods and systems have been described which allow for a calibration of the light bulb assembly 1, in particular of the light source 6 of the light bulb assembly 1, thereby ensuring a homogeneous performance of a plurality of light bulb assemblies 1, even in case of a relatively large manufacturing spread. As indicated above, various illumination characteristics or parameters (e.g. a spectrum of the emitted light, a color of the emitted light and/or an intensity of the emitted light) may be adjusted. In particular, the drive signal 15 which is generated by the driver circuit 12 may be tuned such that the one or more illumination characteristics correspond to one or more target characteristics, respectively.

FIGS. 7 and 8 illustrate a system and a corresponding method for adjusting the settings of the driver circuit 12 in an iterative manner such that ultimately, the light source 6 emits light which meets the target illumination characteristics. For this purpose, the programming unit 60 transmits an input modulated electrical supply signal to the light bulb assembly 1. The driver circuit 12 extracts settings for the driver circuit 12 from the input modulated electrical supply signal and applies the settings to generate a drive signal 15 to the light source 6. The light source 6 emits light L which is captured by the sensor unit 62. The captured light is compared with the target illumination characteristics and if the captured light meets the target illumination characteristics, the last settings are stored within the data storage unit 46 of the controller 16 of the driver circuit 12. Otherwise, the programming unit 60 determines modified settings which are transmitted to the light bulb assembly 1 via an input modulated electrical supply signal. The process is repeated iteratively, until the target illumination characteristics are met, or until a termination condition is met.

The above mentioned iterative calibration process may be time consuming. Furthermore, the transmission of the driver circuit settings via the input modulated electrical supply signal may be prone to transmission errors. As such, it may be desirable to provide a light bulb assembly 1 (and a driver circuit 16) which allows for a more rapid and/or a more reliable calibration process.

In the present document, it is proposed to define one or more test scenarios and to store the test scenarios in the data storage unit 46 of the controller 16. A pre-determined test scenario may comprise or may be defined by:

a sequence of states of the light source 6, wherein each state is indicative of an illumination state of the light source 6. Typically a state is defined by one or more settings for the driver circuit 12, wherein the driver circuit 12 drives the light source 6 to emit light having particular illumination characteristics. and/or a temporal evolution of the sequence of states. The temporal evolution may e.g. define the time interval between two succeeding states of the sequence of states.

The controller 16 may be configured to select a pre-determined test scenario and to execute the pre-determined test scenario, thereby triggering the driver circuit 12 to implement the sequence of states in the defined temporal succession. As a result, the light source 6 emits light in accordance to the sequence of states.

A plurality of test scenarios may be defined and stored in the data storage unit 46. A test scenario may be directed at tuning some (e.g. one) of the target illumination characteristics. By way of example, a first test scenario may be directed at tuning a spectrum of the emitted light and a second test scenario may be directed at tuning the intensity of the emitted light. The controller 16 may be configured to is select some or all of the plurality test scenarios, in order to tune (in a sequential manner) the different target illumination characteristics.

Figure 11A:
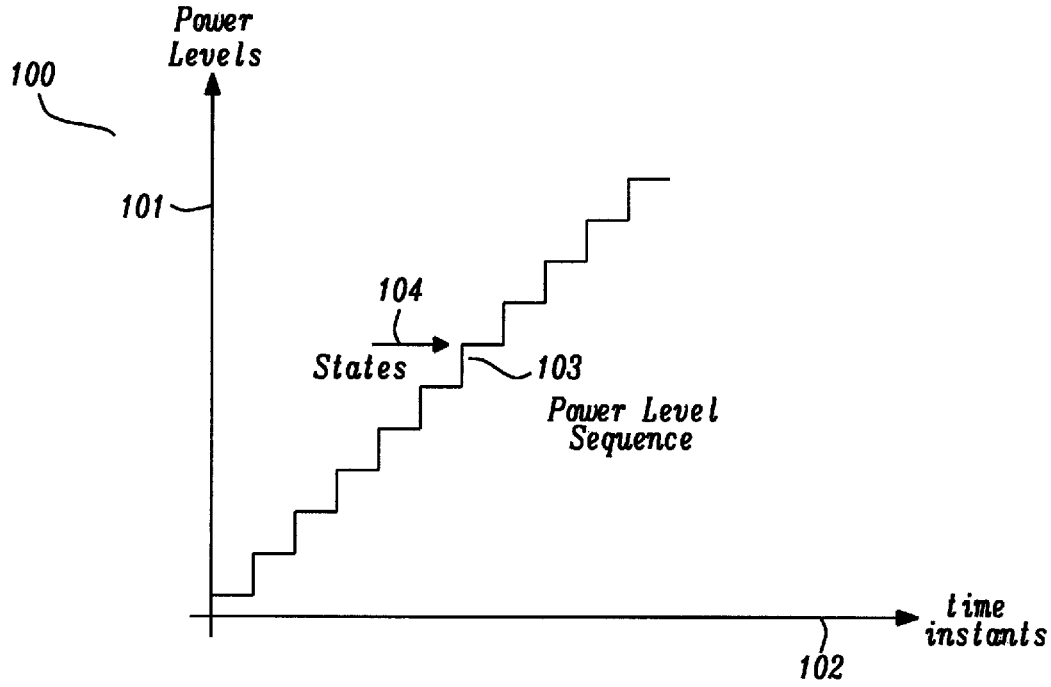
FIGS. 11*a* and 11*b* illustrate example test scenarios for calibration of a light bulb assembly.
Figure 11B:
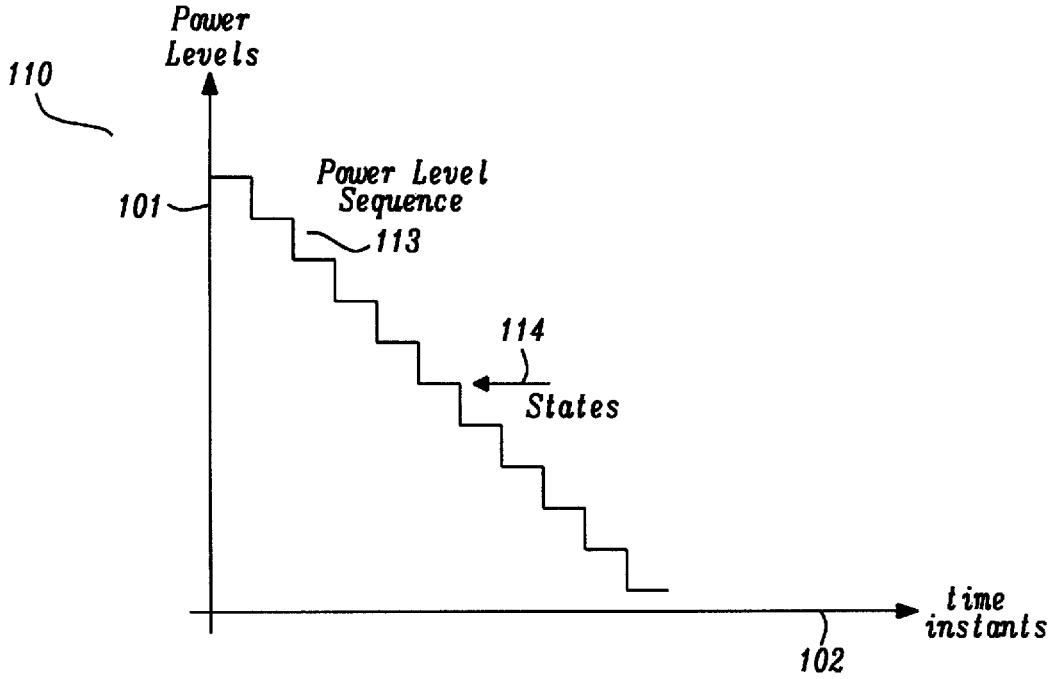

FIGS. 11*a* and 11*b* illustrate example test scenarios 100, 110. The test scenarios 100, 110 define different states which correspond to different levels 101 of power to be delivered to the light source 6. The test scenario 100 specifies a sequence 103 of progressively increasing power levels 101. The power levels 101 are increased in accordance to a corresponding sequence of time instants 102. The test scenario 110 specifies a sequence 113 of progressively decreasing power levels 101. The test scenarios 100, 110 may e.g. be used to tune the intensity of the light source 6 to a target intensity value.

As a result of using pre-defined test scenarios, there is no need to transmit detailed setting information from the programming unit 60 to the driver circuit 12 (in particular to the controller 16). Instead, the programming unit 60 may be limited to starting and/or stopping a test scenario. By way of example, the programming unit 60 may be configured to transmit a start command (also referred to as a start signal) via the input modulated electrical supply signal. The start command triggers the execution of one or more pre-determined test scenarios. During the execution of the one or more pre-determined test scenarios, the sensor unit 62 captures the light emitted by the light source 6 and forwards the captured light signal to the programming unit 60. The programming unit 60 compares the captured light signal to the target illumination characteristics. If it is determined that a deviation of the captured light signal from the one or more target illumination characteristics is below a pre-determined deviation threshold, the programming unit 60 may transmit a stop signal via the input modulated electrical supply signal to the driver circuit 12 (or the controller 16), thereby triggering the driver circuit 12 (or the controller 16) to stop the execution of a current test scenario. Furthermore, the stop signal informs the controller 16 that the currently used state of the test scenario corresponds to the state which is to be used during normal operation of the light bulb assembly. The settings of the currently used state may be stored in the digital storage unit 46 for usage during normal operation.

As such, the calibration process may be performed with reduced information to be transmitted from the programming unit 60 to the light bulb assembly 1 via the input modulated electrical supply signal. In the above example, only a start signal and a stop signal need to be transmitted to the light bulb assembly 1. This information may be transmitted to the light bulb assembly 1 with a limited number of modulation patterns, thereby providing a highly reliable calibration process. By way of example (with reference to FIG. 10), the calibration process which uses pre-determined and pre-stored test scenarios only makes use of start/stop patterns (see FIG. 10), without the need for the transmission of data patterns.

The time interval between succeeding states of the sequence 103 of states is typically selected in accordance to the evaluation speed of the programming unit 60. In particular, it should be ensured that the time required by the programming unit 60 to make a stop decision is shorter than the time interval between succeeding states of the sequence 103 of states. Alternatively or in addition, the programming unit 60 may be configured to transmit a next signal via the input modulated electrical supply signal. The next signal indicates to the controller 16 that the next state of the test scenario 100, 110 can be implemented: As such, the programming unit 60 may be configured to control the temporal course of the sequence 103 of states. Furthermore, the programming unit 60 may be configured to transmit a back signal via the input modulated electrical supply signal. The back signal may indicate to the controller 16 that the previous state of the test scenario 100, 100 should be implemented.

The programming unit 60 and the controller 16 may be configured to execute a plurality of test scenarios one after the other. In particular, an overall calibration process may be defined, wherein the calibration process comprises a plurality of test scenarios which are to be executed one after the other. The plurality of test scenarios and their order (i.e. the overall calibration process) may be stored within the data storage unit 46. The controller 16 may be configured to retrieve the calibration process from the data storage unit 46. Upon reception of a start signal from the programming unit 60, the controller 16 may start execution of the first test scenario. The reception of a stop signal indicates to the controller 16 a first set of settings (according to the state which is active upon reception of the stop signal). Upon reception of a further start signal, execution of the next test scenario is started and so on. As a result, the controller 16 determines a plurality of sets of settings (from the plurality of test scenarios). The controller 16 may be configured to determine a final set of settings from the plurality of sets of settings. By way of example, the controller 16 may be configured to determine the final set of settings from the average of the plurality of sets of settings. The final set of settings may be stored in the data storage unit 46 for usage during normal operation of the light bulb assembly 1.

The above mentioned use of a plurality of test scenarios is illustrated in FIGS. 11*a* and 11*b*. The overall calibration process may comprise the test scenarios 100 and 110. The execution of the first test scenario 100 may yield the state 104 (and the corresponding set of settings), the execution of the second test scenario 110 may yield the state 114 (and the corresponding set of settings). The controller 16 may determine a target set of settings from the states (i.e. sets of settings) 104 and 114.

The set of settings of the driver circuit 12 may comprise one or more of: a duty cycle used by one or more power switches of the power converter 14, a commutation cycle rate used by one or more power switches of the power converter 14, and/or one or more control signals applied to one or more current sources of the driver circuit, wherein the one or more current sources control a current through the one or more SSL sources of the light source 6.

As such, a calibration process may be performed without the need of transmitting the settings of the driver circuit 12 from the programming unit 60 to the light bulb assembly 1. As a result of this, the execution of the calibration process may be accelerated and rendered more robust.

As indicated above, the light bulb assembly 1 may be configured to store the selected set of settings of the driver circuit 12 in a memory of the light bulb assembly 1 (e.g. in the data storage unit 46). In particular, the selected set of settings may be burned into a One-Time Programmable (OTP) memory. As such, the selected set of settings may be kept fixed for the normal operation of the light bulb assembly 1 (subsequent to the calibration phase, which is typically performed as part of a manufacturing process). Furthermore, this may ensure that the selected set of settings cannot be overwritten at a later stage, thereby canceling the results of the calibration phase.

Alternatively or in addition, the controller 16 may be configured to limit the number of calibration phases which may be performed for the light bulb assembly. In particular, the controller 16 may be configured to block any further calibration requests, subsequent to the execution of the limited number of calibration phases (e.g. subsequent to a single initial calibration phase).

The light bulb assembly 1 may be configured to communicate information (e.g. information regarding the selected set of settings) to a receiver which is external to the light bulb assembly 1. As indicated above, this communication may make use of a blinking of the light source 6, thereby communicating information via a modulated optical signal. This may be disadvantageous, as it requires the use of an optical receiver (e.g. a light sensor 62). In the present document, it is proposed to—alternatively or in addition—use a reverse communication channel via the electricity supply signal from the light bulb assembly 1 to an electrical receiver at the mains supply.

The controller 16 may be configured to modulate the amount of power which is used by the light bulb assembly 1. By way of example, the controller 16 may be configured to modulate the drive current towards the light source 6, thereby modulating the amount of power drawn by the light bulb assembly 1 from the mains supply. This modulation of the consumed amount of power leads to variations of the power drawn from the mains supply. In particular, a variation of the current drawn by the light bulb assembly 1 may be observed and detected by an appropriate measurement device (e.g. an electricity meter or a power meter). Hence, by using specific modulation patterns of the consumed amount of power (e.g. the patterns of FIG. 10), corresponding information may be transmitted from the light bulb assembly 1 to the main supply.

Figure 12:
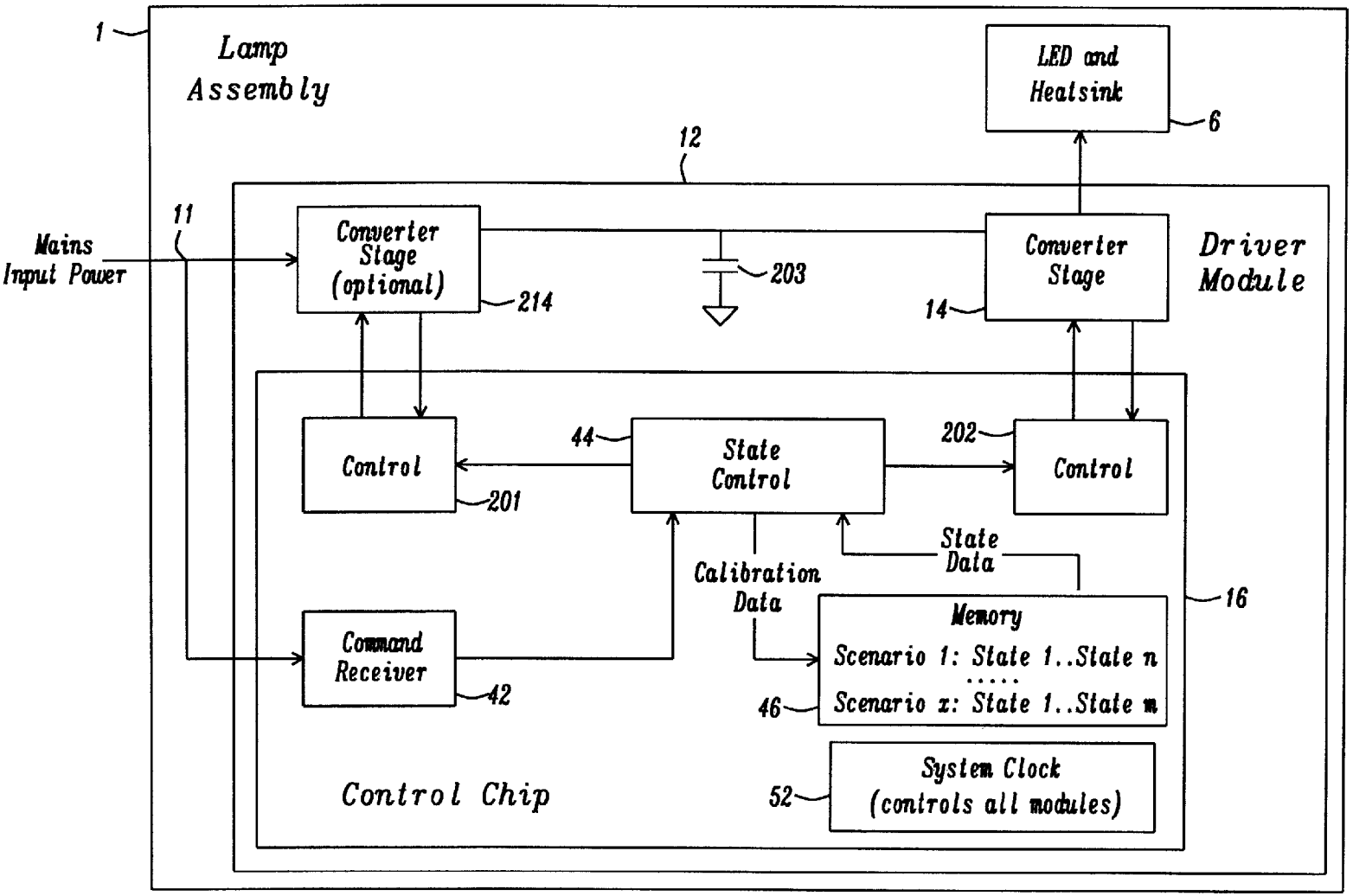
FIG. 12 illustrates a schematic block diagram of an example light bulb assembly.

FIG. 12 shows a block diagram of an example light bulb assembly 1 which is configured to perform a calibration based on pre-stored test scenarios 100, 110. The light bulb assembly 1 of FIG. 12 comprises a multi-stage power converter 214, 14, wherein a first converter stage 214 is coupled to the second converter stage 14 via a capacitor 203. The controller 16 is configured to control the two converter stages 214, 14 using respective control units 201, 202 (which may be implemented as software on the processing unit 44). The controller 16 is configured to receive one or more command signals via the data input unit 42. In response to the received one or more command signals, the processing unit 44 retrieves from the data storage unit 46 and executes one or more test scenarios 100, 110. The controller 16 comprises a central clock signal generator 52 which is configured to generate a clock signal for synchronization of all of the different components of the controller 16.

In the following, particular aspects of the present document are listed:

Aspect 1. A controller for a driver circuit which is operable to provide drive current to a solid state light emitting device of a light bulb assembly, the controller comprising:

a digital data storage unit operable to store control data items;

a digital data processing unit operable to retrieve control data items from the data storage unit, to generate a control signal in dependence upon retrieved control data items, and to output such a control signal; and a data input unit operable to receive data items for storage in the data storage unit via a modulated electricity supply signal.

Aspect 2. A controller according to aspect 1, wherein the control data items relate to a predetermined operating characteristic of such a light emitting device.

Aspect 3. A controller according to aspect 1, wherein the control data items relate to an intensity of an output light signal of such a light emitting device.

Aspect 4. A controller according to aspect 1, wherein the control data items relate to a spectrum of output light signal of such a light emitting device.

Aspect 5. A controller according to aspect 1, wherein the data input unit is operable to detect directly a modulated electricity supply signal and to convert a detected modulated electricity supply signal to control data items for storage in the data storage unit.

Aspect 6. A controller according to aspect 1, wherein the data input unit is operable to detect a voltage change within such a driver circuit, such a voltage change being caused by an input modulated electricity supply signal, and to convert a detected voltage change to control data items for storage in the data storage device.

Aspect 7. A driver circuit for providing a drive current to a solid state light emitting device of a light bulb assembly, the driver circuit comprising:

a power converter circuit operable to receive an electricity supply signal, and to supply an electrical drive signal to a light emitting device of a light bulb assembly;

and a controller comprising:

a digital data storage unit operable to store control data items;

a digital data processing unit operable to retrieve control data items from the data storage unit, to generate a control signal in dependence upon retrieved control data items, and to output such a control signal to the power converter; and a data input unit operable to receive data items for storage in the data storage unit via a modulated electricity supply signal.

Aspect 8. A driver circuit according to aspect 7, wherein the control data items relate to a predetermined operating characteristic of such a light emitting device.

Aspect 9. A driver circuit according to aspect 7, wherein the control data items relate to an intensity of an output light signal of such a light emitting device.

Aspect 10. A driver circuit according to aspect 7, wherein the control data items relate to a spectrum of output light signal of such a light emitting device.

Aspect 11. A driver circuit according to aspect 7, wherein the data input unit is operable to detect directly a modulated electricity supply signal and to convert a detected modulated electricity supply signal to control data items for storage in the data storage unit.

Aspect 12. A driver circuit according to aspect 7, wherein the data input unit is operable to detect a voltage change within such a driver circuit, such a voltage change being caused by an input modulated electricity supply signal, and to convert a detected voltage change to control data items for storage in the data storage device.

Aspect 13. A driver circuit according to aspect 7, wherein the power converter circuit comprises:

a first power converter stage connected to receive an electricity supply signal from the electrical connection module, and operable to draw electrical energy from the electrical connection module in dependence upon a first control signal received from the controller;

a capacitive electrical energy storage device connected for reception of electrical energy from the first power converter stage; and a second power converter stage, connected to receive electrical energy from the first power converter stage and from the electrical energy storage device, and operable to output an electrical drive current to the solid state light emitting device in dependence upon a second control signal received from the controller, and wherein the controller is operable to generate such first and second control signals.

Aspect 14. A light bulb assembly comprising:

a housing;

a solid state light emitting device, located within the housing;

an electrical connection module, attached to the housing, and adapted for connection to an electrical supply;

a driver circuit located within the housing, connected to receive an electricity supply signal from the electrical connection module, operable to supply an electrical drive signal to the light emitting device, and comprising:

a power converter circuit including at least one switching device, and at least one inductive energy storage device, the power converter circuit being operable to receive an electricity supply signal from the electrical connection module, and to output an electrical drive signal to the light emitting device; and a controller comprising:

a digital data storage unit operable to store control data items;

a digital data processing unit operable to retrieve control data items from the data storage unit, to generate a control signal in dependence upon retrieved control data items, and to output such a control signal to the power converter; and a data input unit operable to receive data items for storage in the data storage unit via a modulated electricity supply signal.

Aspect 15. An assembly according to aspect 14, wherein the controller is operable to receive an input signal relating to operation of the light bulb assembly, to generate a control signal in dependence upon such an input signal in combination with behavior information stored in the data storage unit, the behavior information relating to operating characteristics of the light bulb assembly, and to supply a control signal to the power converter circuit for control of the switching device therein Aspect 16. An assembly according to aspect 14, wherein the control data items relate to a predetermined operating characteristic of such a light emitting device.

Aspect 17. An assembly according to aspect 14, wherein the control data items relate to an intensity of an output light signal of such a light emitting device.

Aspect 18. An assembly according to aspect 14, wherein the control data items relate to a spectrum of output light signal of such a light emitting device.

Aspect 19. An assembly according to aspect 14, wherein the data input unit is operable to detect directly a modulated electricity supply signal and to convert a detected modulated electricity supply signal to control data items for storage in the data storage unit.

Aspect 20. An assembly according to aspect 14, wherein the data input unit is operable to detect a voltage change within such a driver circuit, such a voltage change being caused by an input modulated electricity supply signal, and to convert to a detected voltage change to control data items for storage in the data storage device.

Aspect 21. An assembly according to aspect 14, wherein the power converter circuit comprises:

a first power converter stage connected to receive an electricity supply signal from the electrical connection module, and operable to draw electrical energy from the electrical connection module in dependence upon a first control signal received from the controller;

a capacitive electrical energy storage device connected for reception of electrical energy from the first power converter stage; and a second power converter stage, connected to receive electrical energy from the first power converter stage and from the electrical energy storage device, and operable to output an electrical drive current to the solid state light emitting device in dependence upon a second control signal received from the controller, and wherein the controller is operable to generate such first and second control signals.

Aspect 22. A method of programming a controller of a driver circuit which is operable to supply a drive current to a solid state light emitting device of a light bulb assembly, the method comprising:

generating a modulated electricity supply signal which encodes control data items for storage by the controller; and supplying such a modulated electricity supply signal to the controller via an electricity supply connection of the light bulb assembly.

Aspect 23. A method according to aspect 22, further comprising:

causing a drive current to be supplied to a light emitting device of a light bulb assembly;

generating a measurement signal indicative of a parameter of a light signal output by the light emitting device; and determining such control data items in dependence upon the measurement signal.

Aspect 24. A system for programming a controller of a driver circuit which is operable to supply a drive current to a solid state light emitting device of a light bulb assembly, the system comprising:

a programming unit operable to generate a modulated electricity supply signal which encodes control data items for storage by the controller, and to supply such a modulated electricity supply signal to the controller via an electricity supply connection of the light bulb assembly.

Aspect 25. A system according to aspect 24, further comprising a sensor unit operable to generate a measurement signal indicative of a parameter of a light signal output by the light emitting device, and to supply such a measurement signal to the programming unit, wherein the programming unit is operable to determine such control data items in dependence upon a measurement signal received from the sensor unit.

According to a further aspect, a state (e.g. a state within a test scenario) may be configured such that in this state the parameter of light signal output is sensitive to the voltage at the input terminals of the lamp assembly. This can be the voltage level, the frequency, or any other modulation of the voltage. The state may be referred to as a reach-through state. By way of example, a particular state of a test scenario may provide the possibility to vary the intensity level of the light source as a function of the level of the voltage at the input of the light bulb assembly.

What is claimed is:

1. A controller for a driver circuit which is operable to provide a drive current to a light source of a light bulb assembly, the controller comprising:

a data storage unit operable to store a test scenario for calibration of the light bulb assembly; wherein the test scenario is indicative of a sequence of states of the light source; wherein a state of the light source is associated with a set of settings of the driver circuit;

a data input unit operable to receive a command signal via a modulated electricity supply signal; and a data processing unit operable to retrieve the test scenario from the data storage unit;

in dependence of the received command signal, to generate a control signal for operating the light source in at least one state of the sequence of states of the test scenario; and to output the control signal.

2. The controller of claim 1, wherein the data storage unit is configured to store a plurality of sets of settings of the driver circuit, which is associated with the sequence of states, respectively.

3. The controller of claim 1, wherein the command signal may comprises one or more of:

a start signal triggering an execution of the test scenario;

a next signal triggering the operation of the light source in a state of the sequence of states, which follows a current state of the light source; and a stop signal triggering an interruption of the execution of the test scenario.

4. The controller of claim 1, wherein the data processing unit is configured to select one state of the sequence of states based on the received command signal; and determine the final set of settings, which is used by the light bulb assembly subsequent to calibration, based on the set of settings which is associated with the selected state.

5. The controller of claim 4, wherein the selected state corresponds to the state of the sequence of states that the light source is operated in, upon reception of a stop command signal instructing the controller to stop execution of the test scenario.

6. The controller of claim 1, wherein a state of the light source is defined by one or more of the following illumination characteristics: a spectrum of light emitted by the light source; a color of the light emitted by the light source; an intensity of the light emitted by the light source; and a color rendering index of the light source.

7. The controller of claim 1, wherein the test scenario is further indicative of a temporal progression of the sequence of states.

8. The controller of claim 1, wherein the data storage unit is configured to store a plurality of test scenarios comprising a first and a second test scenario;

the data input unit is operable to receive a plurality of command signals via the modulated electricity supply signal; and the data processing unit is configured to determine a first set of settings from the first test scenario and a second set of settings from the second test scenario, based on the plurality of command signals; and to determine a final set of settings, which is used by the light bulb assembly subsequent to calibration, based on the first and second sets of settings.

9. The controller of claim 8, wherein the first test scenario is indicative of a sequence of states of the light source, which alters a first illumination characteristic of light emitted by the light source;

the second test scenario is indicative of a sequence of states of the light source, which alters a second illumination characteristic of the light emitted by the light source; and the first and second illumination characteristics are different from one another.

10. The controller of claim 8, wherein the first test scenario is indicative of a sequence of states of the light source, which alters a first illumination characteristic of light emitted by the light source in a first manner;

the second test scenario is indicative of a sequence of states of the light source, which alters the first illumination characteristic of light emitted by the light source in a second manner; and the first and second manners are different.

11. The controller of claim 1, wherein the data processing unit is operable to generate a control signal for operating the light source in a reach-through state; wherein in the reach-through state an illumination characteristic of light emitted by the light source is sensitive to the electricity supply signal.

12. A driver circuit for a solid state light bulb assembly, the driver circuit comprising:

a power converter operable to output a drive signal to a solid state light source in dependence upon a received control signal; and a controller according to claim 1 operable to provide the control signal to the power converter.

13. A light bulb assembly comprising:

a housing;

a solid state light emitting device, located within the housing;

an electrical connection module, attached to the housing, and adapted for connection to a mains supply; and a driver circuit according to claim 12, located within the housing, connected to receive an electricity supply signal from the electrical connection module, and operable to supply an electrical drive signal to the light emitting device.

14. A calibration system configured to calibrate a light bulb assembly comprising a controller according to claim 1; the calibration system comprising a programming unit configured to control the execution of a test scenario stored in the controller of the light bulb assembly by modulating a command signal onto an electricity supply signal for the light bulb assembly; and a sensor unit configured to capture light emitted by the light bulb assembly; wherein the programming unit is configured to determine the command signal based on the captured light.

* * * * *